US008480176B2

(12) United States Patent
Yamada

(10) Patent No.: US 8,480,176 B2
(45) Date of Patent: Jul. 9, 2013

(54) HEADREST FOR DENTAL TREATMENT CHAIR AND DENTAL TREATMENT CHAIR

(76) Inventor: Tomomi Yamada, Minoo (JP)

( * ) Notice: Subject to any disclaimer, the term of this patent is extended or adjusted under 35 U.S.C. 154(b) by 196 days.

(21) Appl. No.: 13/061,829

(22) PCT Filed: Jun. 24, 2009

(86) PCT No.: PCT/JP2009/002882
§ 371 (c)(1),
(2), (4) Date: Mar. 2, 2011

(87) PCT Pub. No.: WO2010/026687
PCT Pub. Date: Mar. 11, 2010

(65) Prior Publication Data

US 2011/0193380 A1 Aug. 11, 2011

(30) Foreign Application Priority Data

Sep. 3, 2008 (JP) ..... 2008-225984

(51) Int. Cl.
*A47C 1/10* (2006.01)

(52) U.S. Cl.
USPC ..... 297/391

(58) Field of Classification Search
USPC ..... 297/391
See application file for complete search history.

(56) References Cited

U.S. PATENT DOCUMENTS

| | | | | |
|---|---|---|---|---|
| 4,977,600 A | | 12/1990 | Ziegler | |
| 5,133,017 A | * | 7/1992 | Cain et al. | 381/71.6 |
| 6,021,208 A | * | 2/2000 | Kin-Lung | 381/338 |
| 6,086,369 A | * | 7/2000 | Sharp et al. | 433/118 |
| 8,130,987 B2 | * | 3/2012 | Kaneda et al. | 381/302 |
| 2012/0170779 A1 | * | 7/2012 | Hildebrandt | 381/310 |

FOREIGN PATENT DOCUMENTS

| | | |
|---|---|---|
| JP | 59-074349 | 4/1984 |
| JP | 60-184530 | 9/1985 |
| JP | 60-184530 | 12/1985 |
| JP | 63-209641 | 8/1988 |
| JP | 04-242638 | 8/1992 |

(Continued)

OTHER PUBLICATIONS

*Audiometers—Part 1: Pure-Tone Audiometers*, Detailed Standard Information—JIS T 1201-1:2000, Sep. 30, 2000 (Abstract only), published in English.

(Continued)

*Primary Examiner* — Sarah B McPartlin
(74) *Attorney, Agent, or Firm* — Staas & Halsey LLP

(57) ABSTRACT

The invention provides a headrest for a dental treatment chair and a dental treatment chair wherein discomfort due to noise generated from dental treatment instruments can be reduced and communication between a dentist and a patient can be ensured.

The headrest for the dental treatment chair and the dental treatment chair comprise a back head supporting member 91 for supporting a back of the head of the patient during dental treatment and ear supporting members 92 and 92 which can be bent in directions to cover ears of the patient at both ends of the back head supporting member 91. The ear supporting members 92 and 92 or the back head supporting member 91 has sound output sections 93 and 93 each for outputting a sound from a sound source, and the ear supporting members 92 and 92 have a sound collecting section 94 for collecting sounds in a surrounding environment. Acoustic filters 95 and 95 cut off frequencies higher than 8 kHz from a sound signal collected by the sound collecting section 94.

3 Claims, 8 Drawing Sheets

FOREIGN PATENT DOCUMENTS

| | | |
|---|---|---|
| JP | 05-285161 | 11/1993 |
| JP | 05-329134 | 12/1993 |
| JP | 2007-125071 | 5/2007 |
| WO | WO 02/100287 | 12/2002 |

OTHER PUBLICATIONS

*Audiometers—Part 2: Equipment for Speech Audiometry*, Detailed Standard Information—JIS T 1201-1:2000, Sep. 30, 2000 (Abstract only), published in English.

Yamada, T. et al., *Large Spectral Analysis of Sounds from Dental Drilling Equipments*, Trans. Tech. Comm. Physiol. Acoust., The Acoustical Society of Japan, vol. 37, No. 9, Nov. 20, 2007 pp. 743-747.

Yamada, T. et al., *A Study of the Relation Between Subjective Impression and Physical Properties for Improvement of the Sound of Dental Air Turbines*, Osaka University, Mar. 2008, pp. 1005-1006.

International Search Report, mailed Oct. 6, 2009, in corresponding International Application No. PCT/JP2009/002882 (4 pp.).

International Preliminary Report on Patentability in corresponding International Application No. PCT/JP2009/002882 (1 pg.), Translation only.

Dentsply catalog, one page.

Cavitron manual, one page.

* cited by examiner

HEADREST FOR DENTAL TREATMENT CHAIR AND DENTAL TREATMENT CHAIR

This application claims the benefit under 35 U.S.C. Section 371, of PCT International Application No. PCT/JP2009/002882, filed Jun. 24, 2009, which claimed priority to Japanese Application No. 2008-225984, filed Sep. 3, 2008 in the Japanese Patent Office, the disclosures of which are hereby incorporated by reference.

TECHNICAL FIELD

The present invention relates to a headrest for a dental treatment chair and to a dental treatment chair wherein discomfort due to noise generated from dental treatment instruments can be reduced and communication between a dentist and a patient can be ensured.

BACKGROUND ART

Noise level meters are measuring instruments for obtaining important measured values of Environmental Quality Standards for Noise (Environment Agency Notification No. 64 of Sep. 30, 1998), Noise Regulation Law (Law No. 98 of Jun. 10, 1968), and the like. The performance of commonly used noise level meters is prescribed by JIS C 1502, and the frequency range to be measured is from 20 Hz to 8000 Hz. In addition, a sound insulation performance of earplugs which have been conventionally used as a noise prevention measure is from 125 Hz to 8000 Hz (see Patent Document 1), and it has been known that the upper limit of the frequency range in general audibility examinations is 8000 Hz. Therefore, the noise prevention measure has been conventionally targeted to a sound range of 8000 Hz or less.

In addition, in audiometers for audibility diagnosis in conformity with the Japanese Industrial Standard, the highest diagnosis frequency is 8000 Hz, and the high frequency range higher than 8000 Hz is exempt from the diagnosis (see Non-Patent Document 1). Further, also in ear protectors in conformity with the Japanese Industrial Standard, the range of 8000 Hz or less is the targeted frequency of the Standards.

However, noise generated from dental treatment instruments such as an air turbine or a scaler includes a frequency component having a significantly high sound pressure level (see Non-Patent Document 2), and its sound range is higher than 8000 Hz.

In addition, noise generated from the air turbine, the scaler, or the like can cause a painful feeling to a patient. Therefore, in many dental treatment facilities, noise generated from the air turbine, the scaler, or the like is made less audible due to surrounding acoustic effects such as playing music.

PRIOR ART DOCUMENT

Patent Document

Patent Document 1: Japanese Unexamined Patent Publication No. H05-329134

Non-Patent Documents

Non-Patent Document 1: Japanese Industrial Standard (JIS) T1201 "Audiometers", revised on Aug. 1, 2000

Non-Patent Document 2: Tomomi Yamada, Shigeyuki Ebisu, "Large spectral analysis of sounds from dental drilling equipments", November 2007, The Auditory Research Meeting Sponsored by the Technical Committee of Psychological and Physiological Acoustics, The Acoustical Society of Japan, Vol. 37, No. 9, H-2007-129, pp. 743-747

Non-Patent Document 3: Tomomi Yamada, Sonoko Kuwano, Shigeyuki Ebisu, "A study of the relation between subjective impression and physical properties for improvement of the sound of dental air turbines", March 2008, Lecture Papers of The Acoustical Society of Japan, pp. 1005-1006

SUMMARY OF THE INVENTION

Problems to be Solved by the Invention

Although humans can perceive sounds having frequencies to about 20 kHz, not many sounds have frequency components of 8000 Hz or more in a large number of sound sources. However, when a sound has frequency components of 8000 Hz or more, and when its sound pressure level is significantly high, it can be felt as pain. In Non-Patent Document 3, by conducting a psychoacoustical experiment, it has been found that the reduction of the sound pressure level in the sound range of 8000 Hz or more, which hardly affects conversations, daily life, and the like leads to the reduction of the feeling of pain, noisiness, and the like. Therefore, there has been a problem that some noise prevention measures are required to be performed in dental treatment against the sound range having frequencies higher than 8000 Hz, which has been neglected in the conventional noise prevention measures.

In addition, if sounds are merely blocked out as a noise prevention measure, it becomes an obstacle to communication between a patient and a dentist during treatment. In other words, it is required to ensure minimum audibility and to make necessary sound audible from the viewpoint of communication between the patient and the dentist.

Further, when a sound in which only a particular frequency component has a significantly high sound pressure level is heard for a long period of time, there is a fear that a particular peripheral nerve in the auditory nerves is stimulated and that audibility is deteriorated due to an injury to the nerve. Against this fear, the conventional means of prevention only regulates the sound pressure level of noise to a certain value or less, and cannot effectively prevent deterioration in audibility.

The present invention has been made in view of the above circumstances and an object of the present invention is to provide a headrest for a dental treatment chair and a dental treatment chair wherein discomfort due to noise generated from dental treatment instruments can be reduced and communication between a dentist and a patient can be ensured.

Solutions to the Problems

In order to achieve the above object, a headrest for a dental treatment chair according to a first invention, which supports a head of a patient during treatment comprises a back head supporting member for supporting a back of the head of the patient, and ear supporting members which can be bent in directions to cover ears of the patient at both ends of the back head supporting member, wherein the ear supporting members or the back head supporting member has sound output sections each for outputting a sound from a sound source, and a sound collecting section for collecting sounds in a surrounding environment is attached to the ear supporting members so as to be extendable from the ear supporting members, and the ear supporting members form hollow shapes for covering the ears of the patient, and have therein air layers in which air is sealed, wherein the sound output sections have acoustic filters for cutting off frequencies higher than 8 kHz.

In the first invention, the headrest for a dental treatment chair comprises the back head supporting member for supporting the back of the head of the patient, and the ear supporting members which can be bent in the directions to cover the ears of the patient at the both ends of the back head supporting member, wherein the ear supporting members or the back head supporting member has the sound output sections each for outputting a sound from the sound source. Thereby, a sound for reducing noise in the surrounding environment, such as music or a sound having the opposite phase of noise in the surrounding environment, can be outputted, so that discomfort due to noise can be reduced. In addition, the sound collecting section for collecting sounds in the surrounding environment is attached to the ear supporting members so as to be extendable from the ear supporting members. By extending the sound collecting section to a mouth of a dentist, minimum communication between the patient and the dentist can be ensured, whereby the patient can have treatment at ease. Further, the ear supporting members have the hollow shapes for covering the ears of the patient, so that the air layers can be reliably formed between the ears of the patient and the sound output sections, and a sound can be prevented from directly conducting to the ears, whereby an oppressive feeling of the patient can also be reduced. In addition, the ear supporting members have therein the air layers, so that the sound insulation effect against noise in the surrounding environment can be increased. Moreover, the sound output sections have the acoustic filters for cutting off frequencies higher than 8 kHz, so that a sound range higher than 8 kHz, which includes a frequency component having a significantly high sound pressure level in noise generated from a dental treatment instrument such as an air turbine or a scaler can be reliably cut off, whereby discomfort due to noise during dental treatment can be reduced.

In the headrest for a dental treatment chair according to a second invention, in the first invention, the back head supporting member comprises a pressure sensor section for detecting a pressure, and the ear supporting members are bent in directions to sandwich the head of the patient therebetween when the pressure detected by the pressure sensor section is larger than a predetermined value.

In the second invention, the back head supporting member comprises the pressure sensor section for detecting a pressure, and the ear supporting members are bent in the directions to sandwich the head of the patient therebetween when the pressure detected by the pressure sensor section is larger than a predetermined value. Thereby, when the head of the patient is pressed onto the headrest, that is, when the patient reclines his/her head onto the headrest for treatment, the ear supporting members are bent so as to sandwich the head therebetween when the pressure detected by the pressure sensor section exceeds a certain value. Both ears are covered by the ear supporting members, so that only the voice of the dentist collected by the sound collecting section can be outputted from the sound output sections, and noise in the surrounding environment can be reduced while communication between the patient and the dentist can be ensured. In addition, when the pressure detected by the pressure sensor section does not exceed the certain value, the ear supporting members are not bent to sandwich the head therebetween, so that the patient can easily sit up for rinsing his/her mouth or the like.

Next, in order to achieve the above object, a dental treatment chair according to a fifth invention comprises the headrest for a dental treatment chair according to any one of the first, and the second inventions, so that a sound for reducing noise in the surrounding environment, such as music or a sound having the opposite phase of noise present in the surrounding environment, can be outputted, whereby discomfort due to noise during dental treatment can be reduced. In addition, the sound collecting section for collecting sounds in the surrounding environment is attached to the ear supporting members so as to be extendable from the ear supporting members. By extending the sound collecting section to the mouth of the dentist, minimum communication between the patient and the dentist can be ensured, whereby the patient can have treatment at ease.

In addition, when the head of the patient is pressed onto the headrest, that is, when the patient reclines his/her head onto the headrest for treatment, the ear supporting members are bent so as to sandwich the head therebetween when the pressure detected by the pressure sensor section exceeds a certain value, so that only the voice of the dentist collected by the sound collecting section can be outputted from the sound output sections, whereby noise in the surrounding environment can be reduced while communication between the patient and the dentist can be ensured. When the pressure does not exceed the certain value, the ear supporting members are not bent to sandwich the head therebetween, so that the patient can easily sit up for rinsing his/her mouth or the like.

Further, the air layers for reducing noise in the surrounding environment are provided, so that the sound insulation effect only against noise in the surrounding environment can be increased, and a sound range higher than 8 kHz, which includes a frequency component having a significantly high sound pressure level in noise generated from dental treatment instruments such as the air turbine or the scaler can be reliably cut off, whereby discomfort due to noise during dental treatment can be reduced.

Advantages of the Invention

According to the above configurations, a sound for reducing noise in the surrounding environment, such as music or a sound having the opposite phase of noise present in the surrounding environment, can be outputted, whereby discomfort due to noise during dental treatment can be reduced. In addition, the sound collecting section for collecting sounds in the surrounding environment is attached to the ear supporting members so as to be extendable from the ear supporting members. By extending the sound collecting section to the mouth of the dentist, minimum communication between the patient and the dentist can be ensured, whereby the patient can have treatment at ease.

EMBODIMENTS OF THE INVENTION

Figure 1:
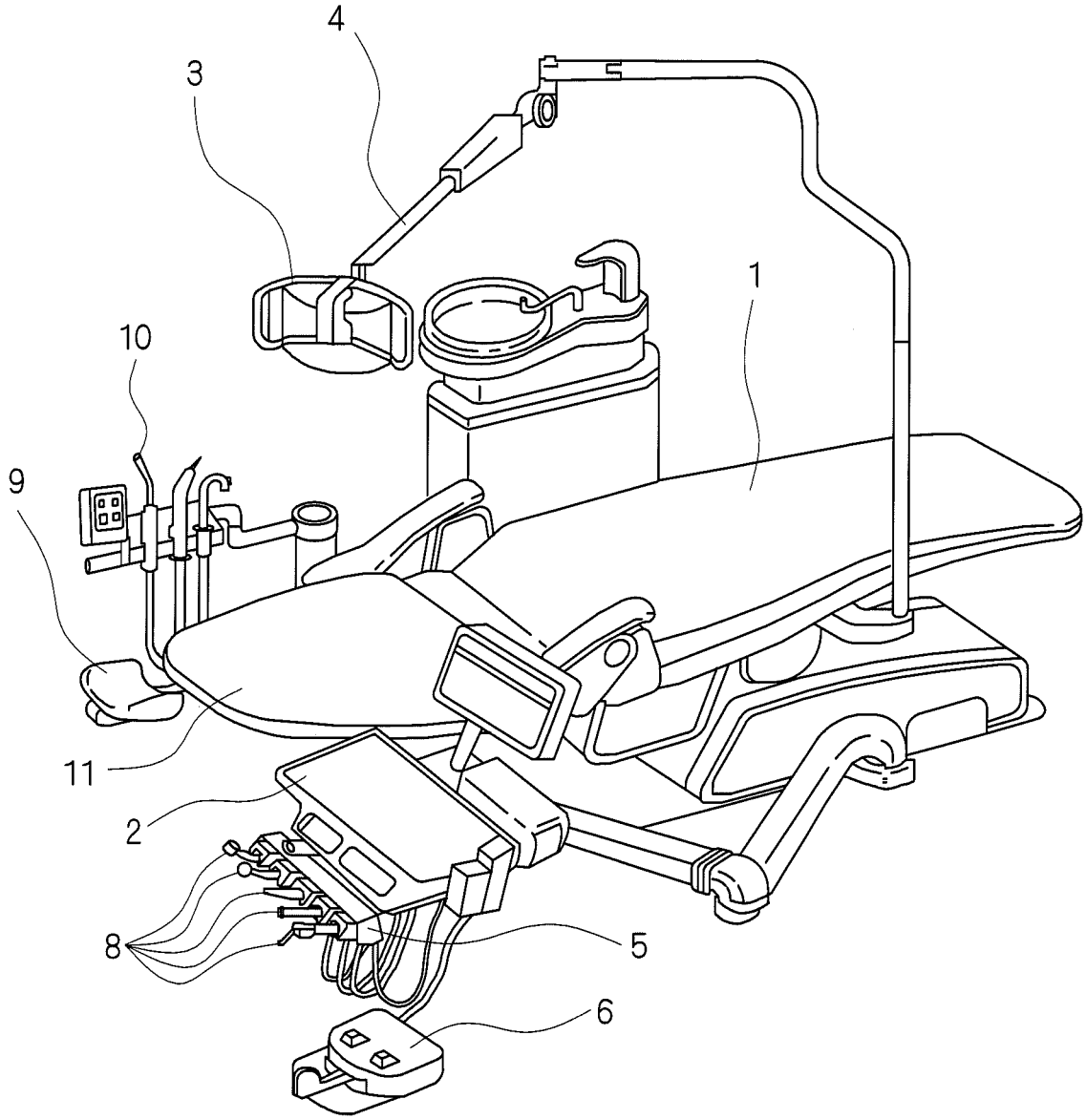
FIG. 1 is a perspective view showing the configuration of a dental treatment chair according to an embodiment of the present invention.

Hereinafter, a dental treatment chair according to an embodiment of the present invention will be described in detail with reference to the drawings. FIG. 1 is a perspective view showing the configuration of the dental treatment chair according to the embodiment of the present invention. The dental treatment chair according to the embodiment of the present invention has a backrest section 11 for supporting a back of a patient, a work table 2 which can be moved to a side of a face of the patient, an astral lamp 3 for illuminating a mouth, and an astral lamp arm 4 for moving the astral lamp 3 around a treatment chair 1 on which the patient sits.

The work table 2 is provided with an instrument holder 5 for accommodating various instruments 8, 8, . . . in dental treatment, e.g., an air turbine handpiece, an engine, and a three-way syringe. The operation of each of the instruments 8 except for the three-way syringe is controlled by a foot switch 6. In addition, a dental vacuum device (suction device) 10 for vacuuming in the mouth and the like are provided on the left ear side of the patient being seated.

During dental treatment, the patient sits on the treatment chair 1 and fixes his/her head onto a headrest 9 to have treatment. During treatment, a dentist performs treatment by changing the posture of the patient so as to be easily treated, that is, by moving the treatment chair 1 up and down, by raising, falling, or inclining the backrest section 11, or the like.

During dental treatment, the dentist performs treatment while communicating with the patient, e.g., while repeating the explanation on the state of a treated portion to the patient and the explanation on a treating method to the patient. Accordingly, when the audibility of the patient is deteriorated, the explanation contents of the dentist sometimes cannot be sufficiently passed to the patient.

In addition, in order to reduce discomfort due to noise generated from the air turbine or the like while drilling a tooth, a noise prevention measure for the reduction of noise in the surrounding environment using ear plugs, headphones, or the like is taken to some of the patients. In this case, the presence itself of the headphones may inhibit communication between the dentist and the patient, with a result that there is a problem of failing to ensure minimum communication between the dentist and the patient.

Figure 2:
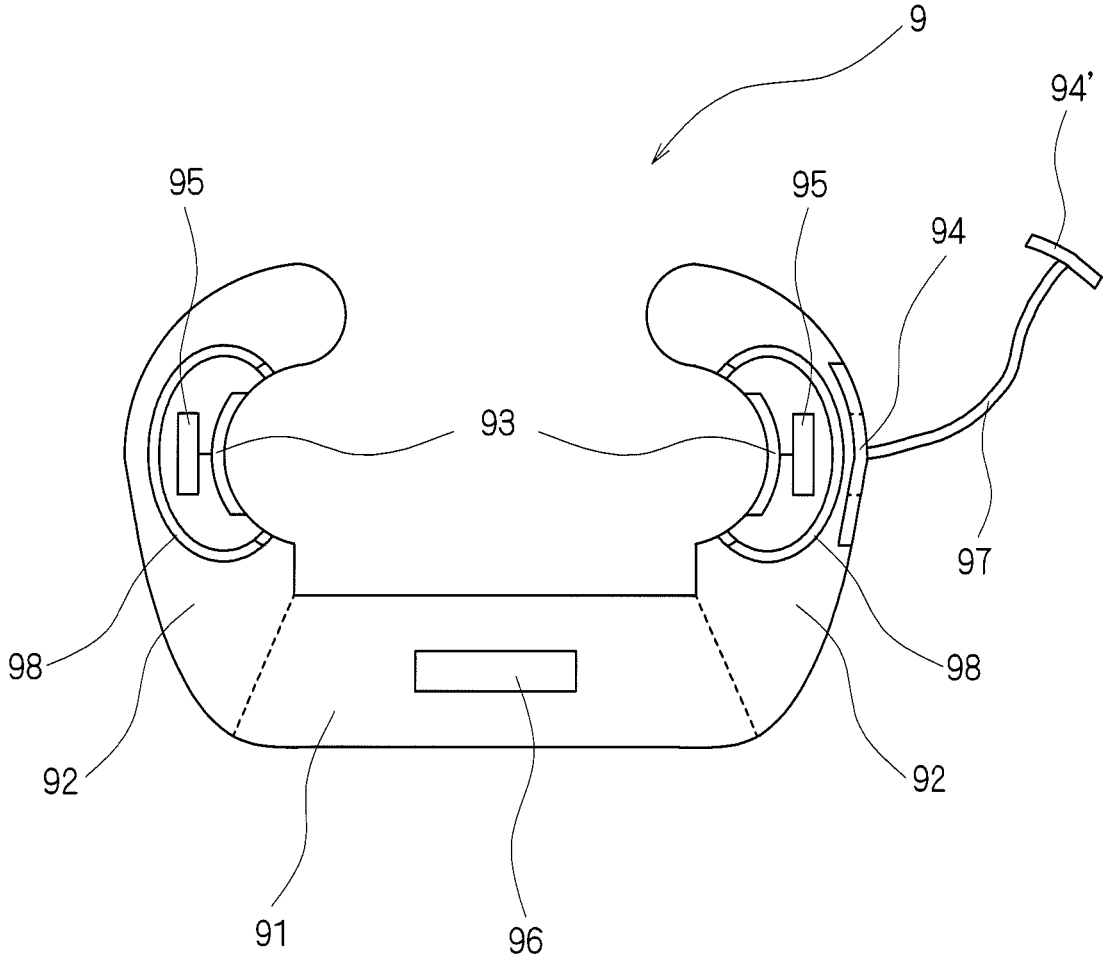
FIG. 2 is a schematic view showing the configuration of a headrest according to an embodiment of the present invention.

Accordingly, the dental treatment chair according to the present embodiment has a feature in that the headrest 9 has speakers serving as sound output sections and a sound collecting section so as to have a shape for covering the ears of the patient. FIG. 2 is a schematic view showing the configuration of the headrest 9 according to the embodiment of the present invention.

As shown in FIG. 2, the headrest 9 according to the present embodiment is configured with a back head supporting member 91 for supporting the back of the head of the patient, and ear supporting members 92 and 92 which can be bent in directions to cover the ears of the patient at both ends of the back head supporting member 91. The back head supporting member 91 and the ear supporting members 92 and 92 are portions which directly contact with the head and ears of the patient, so that at least their surface portions are preferably configured with a material which can absorb any shocks to the head and the like, and is excellent in the sound absorption effect, e.g., a urethane material.

The ear supporting members 92 and 92 are equipped with speakers (sound output sections) 93 and 93 for outputting a sound from a predetermined sound source, e.g., music recorded in a player, which is not shown as a sound signal. The speakers 93 and 93 are not limited to be provided on the ear support members 92 and 92, and may be provided on the back head supporting member 91. In addition, the sound output sections are not limited to the speakers 93 and 93, and may be e.g., bone conduction speakers.

Further, either one of the ear supporting members 92 and 92, preferably, the ear supporting member 92 located on the right side of the patient lying on the back is equipped with a sound collecting section 94 for collecting sounds in the surrounding environment. The provided position and the number of the sound collecting sections 94 are not particularly limited, one sound collecting section 94 may be provided, or one sound collecting section 94 may be provided on each of the ear supporting members 92 and 92 on both sides.

Although the sound collecting section 94 may be a fixed microphone, it is preferable that the sound collecting section 94 can be used a certain distance away from the ear supporting member 92 by a cable or wirelessly. For instance, a sound collecting section 94' is connected to the ear supporting member 92 by a voice cable 97, and the body of the sound collecting section 94' is fixed near the mouth of the dentist, so that minimum communication between the dentist and the patient can be reliably ensured even during dental treatment.

Since, not only the speakers 93 and 93, but also the sound collecting section 94 such as a microphone, is provided in this manner, the speakers 93 and 93 output a sound for reducing a painful feeling during treatment, e.g., favorite music of the patient, and the sound collecting section 94 collects the voice of the dentist during treatment. Thereby, discomfort of the patient due to noise in the surrounding environment can be reduced, the dentist's explanations on the state of a treated portion, a treating method and the like can be reliably collected to pass them to the patient through the speakers 93 and 93, and minimum communication can be ensured.

Further, the back head supporting member 91 is equipped with a pressure sensor (section) 96 for detecting a pressure when the head of the patient is pressed onto the headrest, and the ear supporting members 92 and 92 preferably have mechanisms of being bent from both sides in the directions to sandwich the head of the patient therebetween in a case where the pressure detected by the pressure sensor 96 is larger than a predetermined value. In other words, in a case where the patient sits on the treatment chair 1 and reclines onto the backrest section 11 to press the head onto the headrest 9, when the pressure exceeding a certain value is detected by the pressure sensor 96, the ear supporting members 92 and 92 are moved from the both sides toward the center. Then, the ear supporting members 92 and 92 are operated so as to cover the ears of the patient.

On the contrary, when the patient sits up from the backrest section 11 to rinse his/her mouth or the like and the pressure detected by the pressure sensor 96 is lowered, when the pressure reaches to the certain value or less, the ear supporting members 92 and 92 are moved so as to open toward the both sides. Therefore, the inhibition of the movement of the patient can be prevented.

As the pressure sensor 96, a type is not a question so that a semiconductor type, a strain gage type, and the like may be used. In this case, a pressure value is obtained as an electric signal to judge using a microcomputer or the like whether or not the pressure exceeds the certain value, and when it is judged that the pressure exceeds the certain value, an indication signal is transmitted to a driving source of a micro-motor or the like, so that the ear supporting members 92 and 92 are moved from the both sides toward the center.

Instead of so-called sensors for outputting the electric signal, a urethane material such as urethane sponge and the like may be used, in which a deformation exceeds a predetermined amount to bend the ear supporting members 92 and 92 joined thereto when the pressure of the certain value is added. In this case, the pressure sensor 96 can have a simplified configuration without needing any electric element.

Figure 3A:
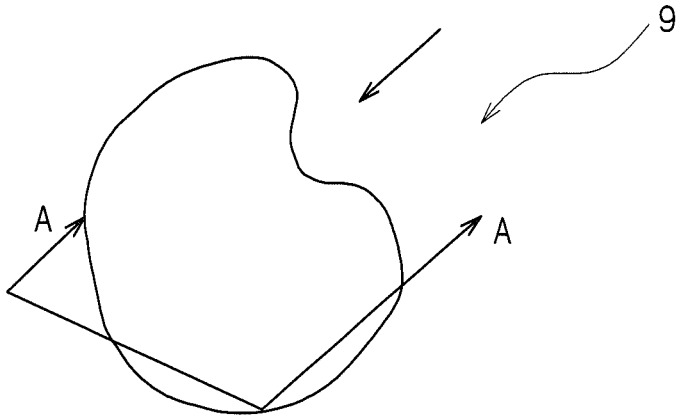
FIG. 3(*a*) is a perspective view showing a configuration example of the headrest according to the embodiment of the present invention when the headrest is configured with a urethane material, and FIGS. 3(*b*) and 3(*c*) are cross-sectional views thereof.
Figure 3B:
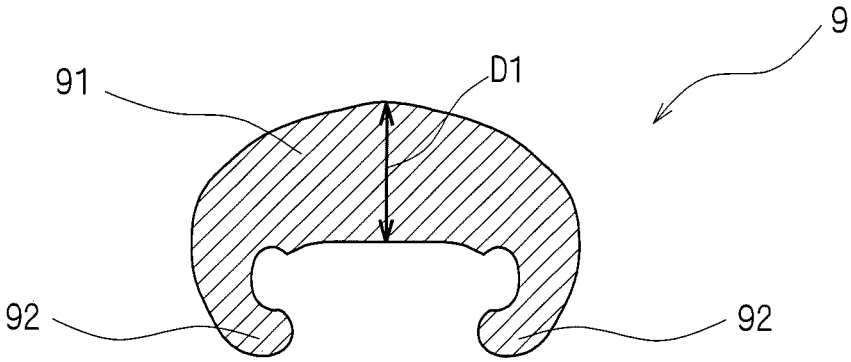
Figure 3C:
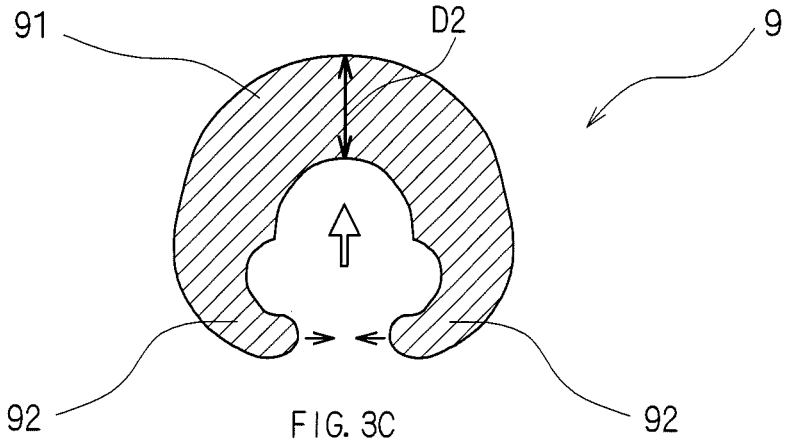

FIG. 3(*a*) is a perspective view showing a configuration example of the headrest 9 according to the embodiment of the present invention when the headrest 9 is configured with the urethane material, and FIGS. 3(*b*) and 3(*c*) are cross-sectional views thereof. As shown in the perspective view of FIG. 3(*a*), the headrest 9 has a shape such as to hollow out a spherical front surface and can cover the whole head of the patient from the direction indicated by arrows.

FIG. 3(*b*) is a cross-sectional view taken along line A-A of FIG. 3(*a*). As shown in FIG. 3(*b*), since the headrest 9 is configured with a soft urethane material, a thickness D1 of the back head supporting member 91 for supporting the back of the head is set to be relatively large. Then, when the back of the head is pressed onto the back head supporting member 91, the thickness D1 is reduced to D2, as shown in FIG. 3(*c*), and the ear supporting members 92, 92 at both right and left ends are moved toward the center accordingly. Thereby, the ears of the patient are covered by the ear supporting members 92, 92, so that noise in the surrounding environment can be reduced.

Further, as shown in FIG. 2, it is preferable that the portions of the ear supporting members 92 and 92 moved toward the ears of the patient form hollow shapes so as to cover the ears of the patient, and have therein air layers 98 and 98 in which air is sealed so as to cover the speakers 93 and 93 and acoustic filters 95 and 95 which are to be described later. With the ear supporting members 92 and 92 forming the hollow shapes, direct sound conduction between the speakers 93 and 93 and the ears can be prevented and an oppressive feeling can be reduced. In addition, with the presence of the air layers 98, the sound insulation effect against noise in the surrounding environment can be enhanced.

Further, in the present embodiment, the acoustic filters 95 and 95 are provided for cutting off a frequency bandwidth higher than 8 kHz from a sound signal before a sound is outputted to the speakers 93 and 93. The acoustic filters 95 and 95 are configured as low-pass filters for cutting off the frequency bandwidth higher than 8 kHz from the sound signal to be outputted.

Figure 4:
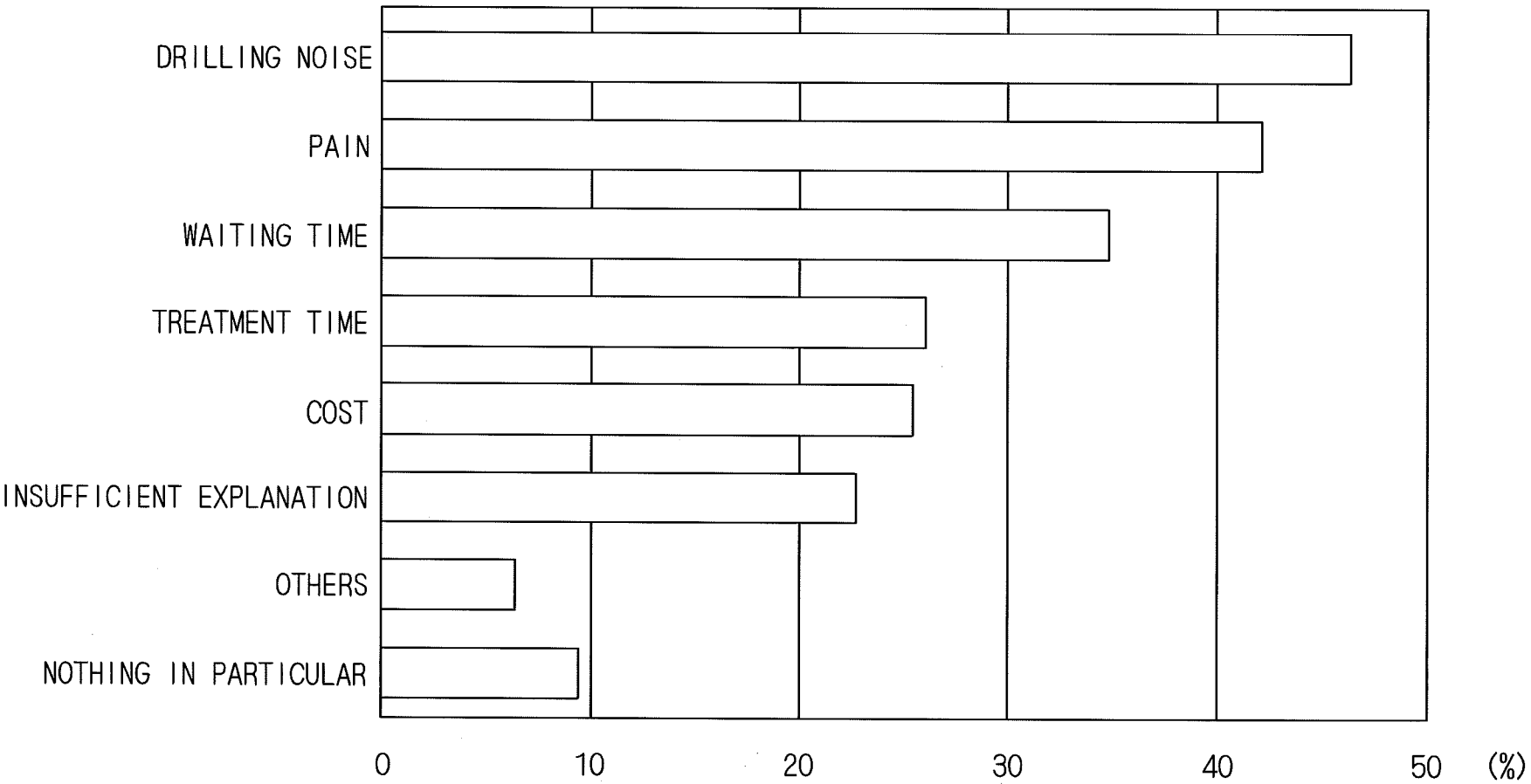
FIG. 4 is a bar graph showing questionnaire results of discomfort matters in dental treatment.

FIG. 4 is a bar graph showing questionnaire results of discomfort matters in dental treatment (a population of 559). As shown in FIG. 4, drilling noise generated from dental drill which has high-frequency components is the most discomfort matter as compared with factors such as pain, waiting time, or the like. Hence, the image of dental treatment can be improved dramatically only by preventing the drilling noise.

Figure 5:
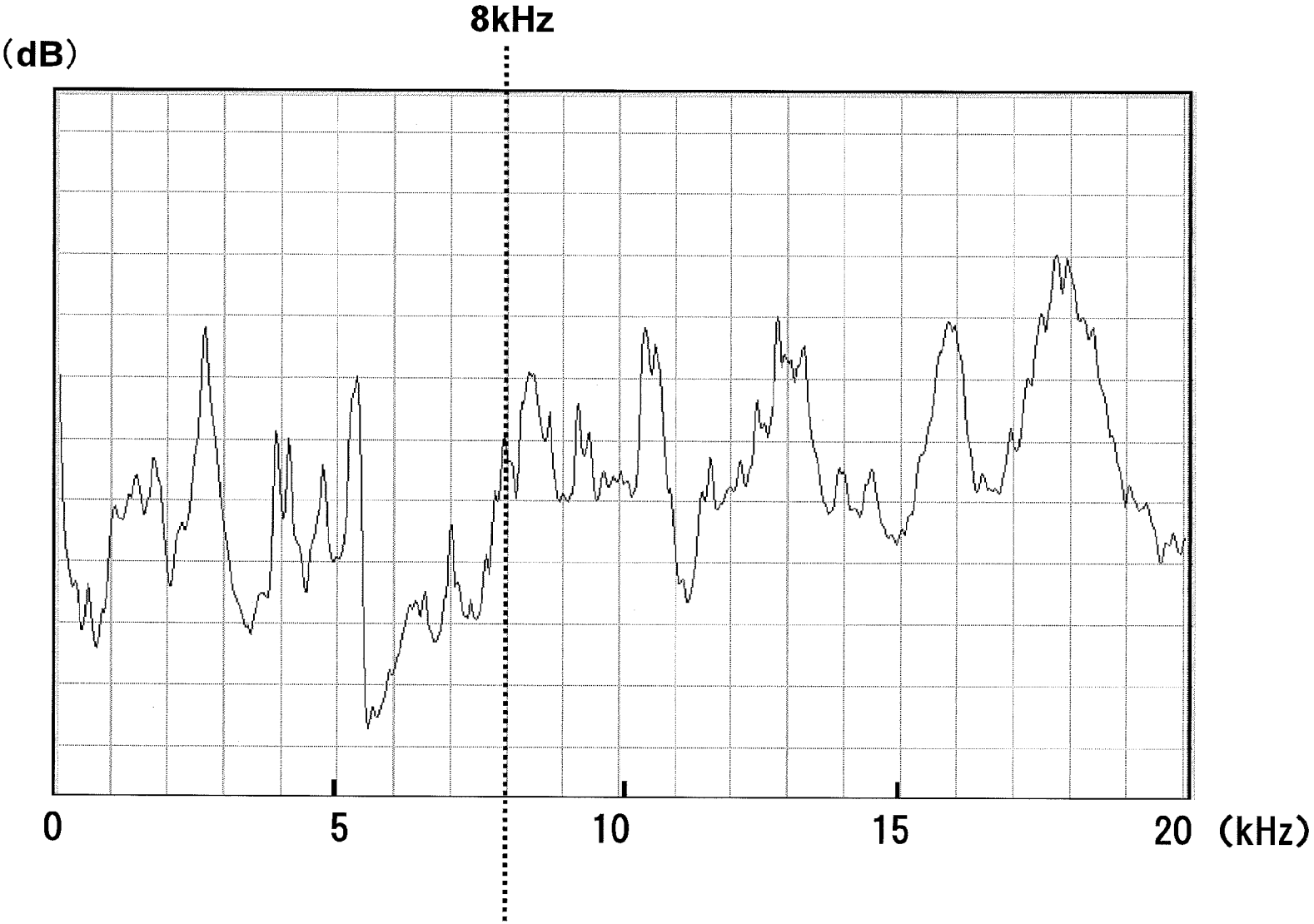
FIG. 5 is a graph showing the frequency distribution of a sound pressure level of noise generated from one kind of air turbines in dental treatment.
Figure 6:
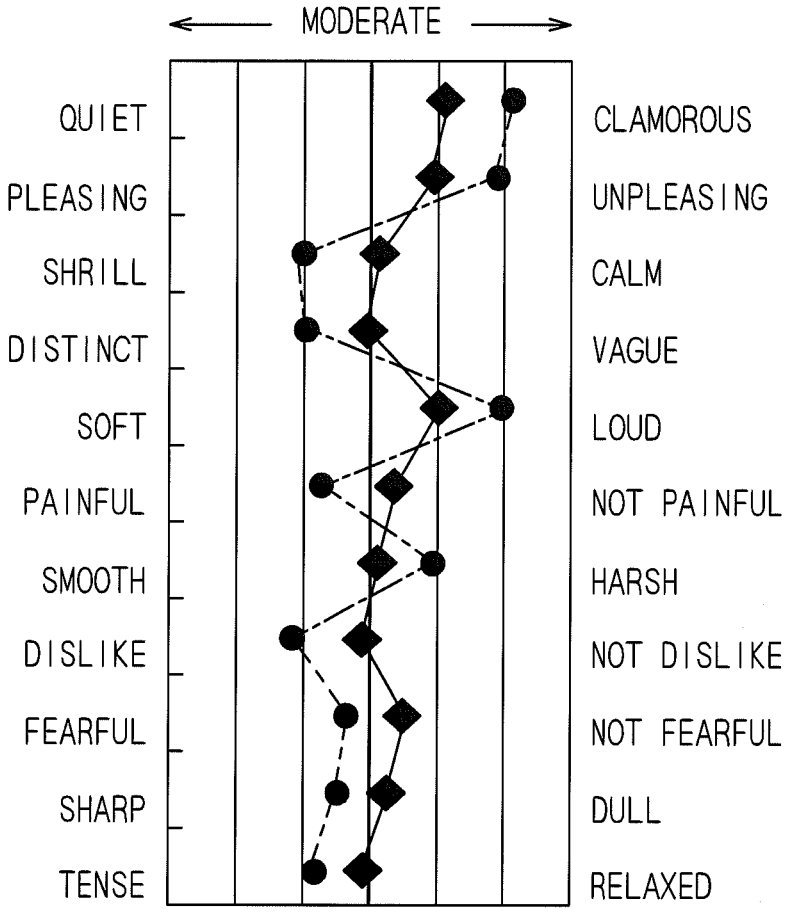
FIG. 6 is an illustrated chart of psychoacoustical experimental results in which sound impressions when in noise generated from the air turbine in dental treatment, only a sound pressure level in a frequency bandwidth higher than 8 kHz is reduced by 10 dB are evaluated using SD method.

FIG. 5 is a graph showing the frequency distribution of a sound pressure level of noise generated from one kind of air turbines in dental treatment. As seen from FIG. 5, it is found that sound pressure level is generated higher in the frequency bandwidth higher than 8 kHz than in other frequency bandwidths. In addition, FIG. 6 is an illustrated chart of psychoacoustical experimental results in which sound impressions when in noise generated from the air turbine in dental treatment, only the sound pressure level in the frequency bandwidth higher than 8 kHz is reduced by 10 dB are evaluated using SD (Semantic Differential) method. The dashed line of FIG. 6 shows the results before the sound pressure level is reduced by 10 dB, and the solid line thereof shows the results after the sound pressure level is reduced by 10 dB.

As shown in FIG. 6, after the sound pressure level in the frequency bandwidth higher than 8 kHz, which is infrequently detected in common noise, is reduced, an effect is seen that the painful feeling of the patient is reduced and that a fear in dental treatment is suppressed.

Hence, the sound is outputted through the acoustic filters 95 and 95 serving as low-pass filters, so that even when noise in the surrounding environment is significantly large, discomfort due to dental treatment can be greatly reduced.

Figure 7:
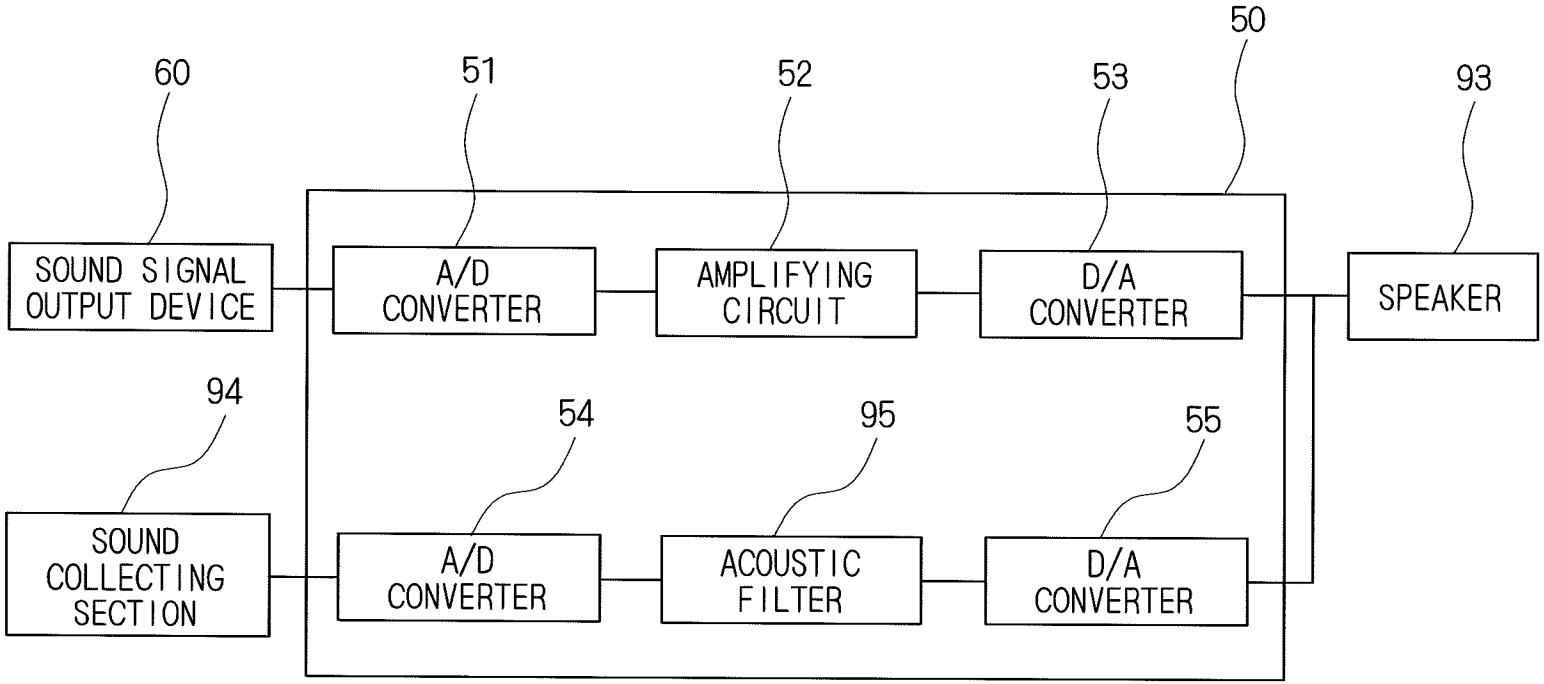
FIG. 7 is a block diagram showing a configuration example of a sound signal control section incorporated into the headrest.

In this case, although a sound signal of music or the like outputted from a sound signal output device provided outside and a sound signal collected by the sound collecting section 94 are outputted from the speakers 93 and 93, it is the sound signal collected by the sound collecting section 94 that is outputted through the acoustic filters 95 and 95. Hence, actually, the acoustic filters 95 and 95 are not directly connected to the speakers 93 and 93, but a sound signal control section for conducting an amplification, a filtering, or the like a sound signal is provided at an appropriate position in the course where the sound signal is transmitted to the speakers 93 and 93. FIG. 7 is a block diagram showing a configuration example of the sound signal control section incorporated into the headrest 9.

As shown in FIG. 7, a sound signal control section 50 obtains a sound signal of music or the like from a sound signal output device 60 provided outside, and converts the signal to a digital signal by an A/D converter 51. The digitalized sound signal is amplified by predetermined times by an amplifying circuit 52, and is reconstructed to an analog signal by a D/A converter 53 so as to be outputted from the speakers 93 and 93.

On the other hand, the sound signal collected by the sound collecting section 94 is also converted to a digital signal by an A/D converter 54, and the frequency bandwidth higher than 8 kHz is cut off by the acoustic filter 95 (filtering). The filtered sound signal is reconstructed to an analog signal by a D/A converter 55 so as to be outputted from the speakers 93 and 93.

With such a configuration, any sound signal of 8 kHz or less is not filtered, and the frequency bandwidth of 8 kHz or more in which the possibility is high that discomfort occurs depending on the sound pressure level can be reliably cut off. Hence, favorite music or the like of the patient can be stably outputted without cutting off the frequency bandwidth, and at the same time, the frequency bandwidth higher than 8 kHz of the collected sound signal can be reliably cut off from the collected sound signal, so that discomfort of the patient due to noise during dental treatment can be reduced.

Needless to say, various modifications and substitutions can be made within the scope of the purport of the present invention. For instance, the mechanisms of bending the ear supporting members 92 and 92 may be equipped with biasing members for biasing the ear supporting members 92 and 92 in the opposite directions of the directions to press the head, so that when the head is not pressed, the ear supporting members 92 and 92 are open at all times, and only when the head is pressed, the ear supporting members 92 and 92 are bent in the directions to cover the ears against the biasing forces of the biasing members.

Further, the timings to start/end sound collection by the sound collecting section 94 may be controlled by a separate switch or the like. For instance, the foot switch 6 arranged at the feet of the dentist is equipped with a button to turn on and off the sound collection function of the sound collecting section 94, so that sound collection is started when the button is stepped on at an arbitrary timing during dental treatment, and the sound collection is ended when the button is stepped on again. In this way, sound collection is started by the foot switch 6 at the timing when the tooth is not drilled to have communication with the dentist, and when the tooth is drilled, sound collection is ended by the foot switch 6 to suppress noise. On the contrary, sound collection may be started by the foot switch 6 at the timing when the tooth is drilled, so that noise generated from the air turbine or the like may be filtered so as to reduce discomfort of the patient. Of course, the bending operations of the ear supporting members 92, 92 may be controlled by a switch or the like.

Figure 8A:
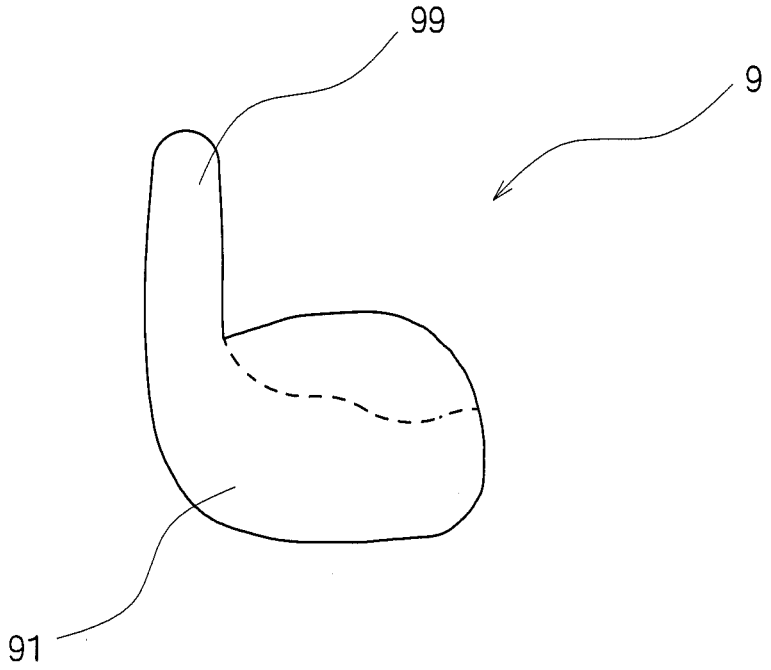
FIGS. 8(*a*) and 8(*b*) are schematic views each showing the configuration of the headrest having a light masking member.
Figure 8B:
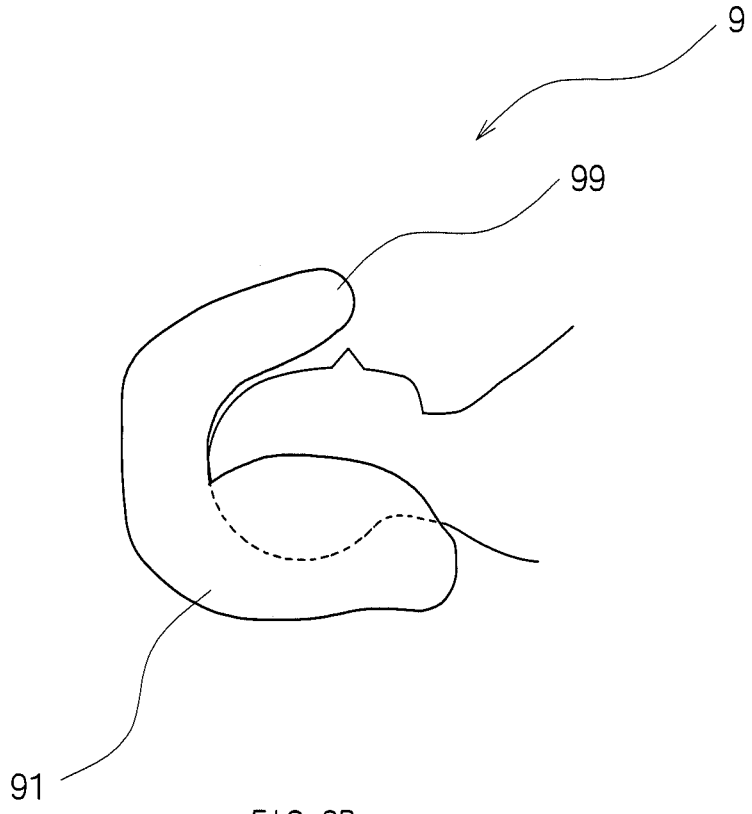

Furthermore, when the headrest 9 is configured with a soft urethane material, by applying the mechanisms that the ear supporting members 92 and 92 are operated so as to cover the ears of the patient, a light masking member having a smaller thickness than other portions may be formed in the height direction of the head, thereby the light masking member is lowered to lightly mask the eyes of the patient in a state where the whole head of the patient is accommodated. FIGS. 8(*a*) and 8(*b*) are schematic views showing the configuration of the headrest 9 having the light masking member.

As shown in FIG. 8(*a*), when the head of the patient is not placed on the back head supporting member 91, a light masking member 99 is supported in the substantially vertical direction and does not mask the visibility of the patient. On the other hand, as shown in FIG. 8(*b*), when the head of the patient is placed on the back head supporting member 91, the back head supporting member 91 is compressed and the light masking member 99 is fallen to an angle at which the eyes of the patient are lightly masked.

In this configuration, the light masking member 99 exhibits the same function as a sun visor and the dazzling of the eyes of the patient due to the light of the astral lamp 3 for illuminating his/her mouth can be prevented. Moreover, since the eyes are not required to be completely covered with a towel or the like to prevent the dazzling, the visibility itself of the patient can be ensured, so that the patient can have treatment without having any uneasy feeling to dental treatment. In addition, the light masking member 99 can prevent water and drilling pieces from entering the eyes during treatment, which is safe. Further, the form of the light masking member 99 is not particularly limited, and may have a shape for covering the whole face. In this case, from the viewpoint of ensuring the visibility of the patient, the light masking member 99 is preferably formed of a transparent member.

DESCRIPTION OF REFERENCE SIGNS

9: Headrest
91: Back head supporting member
92: Ear supporting member
93: Speaker (sound output section)
94, 94': Sound collecting section
95: Acoustic filter
96: Pressure sensor (section)

The invention claimed is:

1. A headrest for a dental treatment chair which supports a head of a patient during treatment comprising:

a back head supporting member for supporting a back of the head of the patient; and ear supporting members which can be bent in directions to cover ears of the patient at both ends of the back head supporting member, wherein the ear supporting members or the back head supporting member has sound output sections each for outputting a sound from a sound source, a sound collecting section for collecting sounds in a surrounding environment is attached to the ear supporting members so as to be extendable from the ear supporting members, and the ear supporting members form hollow shapes for covering the ears of the patient, and have therein air layers in which air is sealed, wherein the sound output sections have acoustic filters for cutting off frequencies higher than 8 kHz.

2. The headrest for a dental treatment chair according to claim 1, wherein the back head supporting member comprises a pressure sensor section for detecting a pressure, and the ear supporting members are bent in directions to sandwich the head of the patient therebetween when the pressure detected by the pressure sensor section is larger than a predetermined value.

3. A dental treatment chair comprising the headrest for a dental treatment chair according to any one of claims 1 and 2.

* * * * *